US009822737B2

(12) United States Patent
Dudar et al.

(10) Patent No.: US 9,822,737 B2
(45) **Date of Patent: *Nov. 21, 2017**

(54) SYSTEM AND METHODS FOR A LEAK CHECK MODULE COMPRISING A REVERSIBLE VACUUM PUMP

(71) Applicant: Ford Global Technologies, LLC, Dearborn, MI (US)

(72) Inventors: Aed M. Dudar, Canton, MI (US); Dennis Seung-Man Yang, Canton, MI (US); Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 403 days.

This patent is subject to a terminal disclaimer.

(21) Appl. No.: 14/248,024

(22) Filed: Apr. 8, 2014

(65) Prior Publication Data

US 2015/0285171 A1 Oct. 8, 2015

(51) Int. Cl.
*F02M 25/08* (2006.01)
*F02N 11/08* (2006.01)

(52) U.S. Cl.
CPC .... *F02M 25/0809* (2013.01); *F02M 25/0836* (2013.01); *F02N 11/0814* (2013.01)

(58) Field of Classification Search
CPC ..... F02M 25/0836; F02M 25/0809; F02M 25/0818; F02M 25/089; F02M 2025/0845; F02N 11/0814; F02D 41/0037; F02D 41/00
USPC ..... 73/40
See application file for complete search history.

(56) References Cited

U.S. PATENT DOCUMENTS 5,637,788 A 6/1997 Remboski et al.
5,881,700 A 3/1999 Gras et al.
5,975,062 A 11/1999 Bonse et al.

FOREIGN PATENT DOCUMENTS

DE EP 0969198 A2 * 1/2000 ..... F02M 25/08
EP 0969198 B1 8/2003

OTHER PUBLICATIONS

Anonymous, "Method to reduce fuel volatility in PHEV vehicles to improve Evap monitor robustness and emissions," IPCOM No. 000238130D, Published Aug. 4, 2014, 2 pages.
Anonymous, "An Onboard Canister Aging Scheme for Shed Testing for HEV Vehicles," IPCOM No. 000238398D, Published Aug. 22, 2014, 2 pages.

(Continued)

*Primary Examiner* — Hezron E Williams
*Assistant Examiner* — Marrit Eyassu
(74) *Attorney, Agent, or Firm* — James Dottavio; McCoy Russell LLP

(57) ABSTRACT

A method for a fuel system, comprising: indicating a leak in a fuel tank following applying a vacuum to the fuel tank by running a vacuum pump in a first direction; then purging a fuel vapor canister to the fuel tank by running the vacuum pump in a second direction, opposite the first direction. In this way, the fuel vapor canister may be purged of its contents following a fuel system leak check. This may reduce bleed emissions while increasing the efficiency of the vehicle, as the engine does not need to be turned on in order to purge the canister.

11 Claims, 10 Drawing Sheets

(56) References Cited

U.S. PATENT DOCUMENTS

| | | | | |
|---|---|---|---|---|
| 6,036,456 | A | 3/2000 | Peters et al. | |
| 6,689,196 | B2 | 2/2004 | Amano et al. | |
| 6,761,154 | B2 | 7/2004 | Takagi et al. | |
| 7,448,367 | B1 | 11/2008 | Reddy et al. | |
| (Continued) | | | | |
| 7,942,134 | B2 | 5/2011 | Peters et al. | |
| 8,056,397 | B2 | 11/2011 | Herzog et al. | |
| 8,495,988 | B2 | 7/2013 | Reddy | |
| 8,534,400 | B2 | 9/2013 | Stanek et al. | |
| 2004/0123845 | A1* | 7/2004 | Nishioka | F02M 25/0809 123/520 |
| 2007/0051168 | A1* | 3/2007 | Kato | F02M 25/0809 73/49.7 |
| 2009/0084363 | A1 | 4/2009 | Reddy | |
| 2011/0308302 | A1* | 12/2011 | Makino | F02M 25/0836 73/40.7 |
| 2012/0215399 | A1* | 8/2012 | Jentz | G01M 3/025 701/32.8 |
| 2013/0096757 | A1* | 4/2013 | Fukui | F02M 25/0809 701/22 |
| 2015/0040645 | A1* | 2/2015 | Takakura | F02M 25/0818 73/47 |

OTHER PUBLICATIONS

Anonymous, "An AIS Active Purge Method for PHEV Vehicles," IPCOM No. 000238747D, Published Sep. 16, 2014, 2 pages.

Anonymous, "A Carbon Canister Integrity Diagnostic for HEV Using ELCM Pump," IPCOM No. 000238913, Published Sep. 24, 2014, 2 pages.

Dudar, Aed M. et al., "Fuel System Leak Check Based on Fuel Reid Vapor Pressure," U.S. Appl. No. 14/069,176, filed Oct. 31, 2013, 45 pages.

Deronne, M. et al., "The Development and Implementation of an Engine Off Natural Vacuum Test for Diagnosing Small Leaks in Evaporative Emissions Systems," SAE Technical Paper Series No. 2003-01-0719, 2003 SAE World Congress, Detroit, MI., Mar. 3-6, 2003, 13 pages.

Kobayashi, M. et al., "Evaporative Leak Check System by Depressurization Method," SAE Technical Paper Series No. 2004-01-0143, 2004 World Congress, Detroit, MI., Mar. 8-11, 2004, 9 pages.

Chambon, P. et al., "PHEV Cold Start Emissions Management," SAE Technical Paper Series No. 2013-01-0358, Oak Ridge National Laboratory, 9 pages.

* cited by examiner

SYSTEM AND METHODS FOR A LEAK CHECK MODULE COMPRISING A REVERSIBLE VACUUM PUMP

BACKGROUND AND SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of leaks that could release fuel vapors to the atmosphere. In a typical leak test, a vacuum is applied to the fuel system. The integrity of the system is determined by monitoring the decay of the applied vacuum or by comparing the resulting fuel system pressure to an expected pressure. The vacuum source may be the intake manifold of the vehicle engine.

In some vehicles, such as hybrid electric vehicles, the vehicle engine may not run frequently, or may not generate enough vacuum to conduct a leak test. Such vehicles are required to have an evaporative leak check module (ELCM) coupled to the fuel system. The ELCM includes a vacuum pump that can be coupled to the fuel system for leak testing. When applying a vacuum to the fuel tank, fuel vapors may be drawn into the fuel vapor canister. Again, the limited engine run time may limit opportunities to purge the fuel vapor canister to intake. In particular, if the leak check is performed following a key-off event, the loaded fuel vapor canister may soak over a diurnal cycle, increasing bleed emissions.

A typical ELCM also contains a reference orifice. As a reference check, the ELCM may be isolated from the fuel system, and the vacuum pump activated to draw a vacuum on the reference orifice. The resulting pressure serves as a reference for leaks of equivalent size. By using an internal reference orifice, the ELCM automatically calibrates for factors such as ambient temperature, humidity, and barometric pressure. However, an ELCM coupled to the fuel tank via the fuel vapor canister will not compensate for fuel Reid Vapor pressure, as any fuel vapor will be adsorbed by the canister. In the case of highly volatile fuel, the fuel vapor may counteract the vacuum, and thus the fuel tank vacuum during the leak test may be unable to reach the reference vacuum during an allotted testing time. This may result in false failures of the ELCM based leak test.

The inventors herein have recognized the above problems and have developed systems and methods to at least partially address them. In one example, a method for a fuel system, comprising: indicating a leak in a fuel tank following applying a vacuum to the fuel tank by running a vacuum pump in a first direction; then purging a fuel vapor canister to the fuel tank by running the vacuum pump in a second direction, opposite the first direction. In this way, the fuel vapor canister may be purged of its contents following a fuel system leak check. This may reduce bleed emissions while increasing the efficiency of the vehicle, as the engine does not need to be turned on in order to purge the canister.

In another example, a fuel system for a vehicle, comprising: a fuel tank coupled to a fuel vapor canister via a fuel tank isolation valve; an evaporative leak check module coupled between the fuel vapor canister and atmosphere, the evaporative leak check module comprising a reversible vacuum pump; and a control system configured with instructions stored in non-transitory memory, that when executed cause the control system to: determine a reference vacuum threshold; then open a fuel tank isolation valve; determine a first fuel system pressure by drawing a vacuum on the fuel system via operating the reversible vacuum pump in a first direction; indicate a fuel system leak based on a comparison of the first fuel system pressure and the reference vacuum threshold; then purge contents of the fuel vapor canister to the fuel tank by operating the reversible vacuum pump in a second direction, opposite the first direction, while maintaining the fuel tank isolation valve open. In this way, the canister load may be reduced in hybrid vehicles, which may otherwise go for long periods without an opportunity to purge the canister to intake. Evaporative emissions regulations require testing of the fuel system, which may draw fuel vapor into the canister even if the engine is not in use. By incorporating a reversible vacuum pump, the canister can be cleaned, and fuel vapor returned to the fuel tank.

In yet another example, a fuel system for a vehicle, comprising: a fuel tank coupled to a fuel vapor canister via a fuel tank isolation valve; a canister vent valve coupled between the fuel vapor canister and atmosphere; an evaporative leak check module coupled between the fuel tank isolation valve and the fuel vapor canister, the evaporative leak check module comprising a reversible vacuum pump; and a control system configured with instructions stored in non-transitory memory, that when executed cause the control system to: open the fuel tank isolation valve; then determine a reference vacuum threshold; determine a first fuel tank pressure by drawing a vacuum on the fuel tank via operating the reversible vacuum pump in a first direction with the canister vent valve opened; determine a first fuel system pressure by drawing a vacuum on the fuel system via operating the reversible vacuum pump in a second direction, opposite the first direction, with the canister vent valve closed; indicate a fuel tank leak based on a comparison of the first fuel tank pressure to the reference vacuum threshold; and indicate a leak in the fuel system that is not in the fuel tank based on a comparison of the first fuel system pressure and the reference vacuum threshold. In this way, the reference vacuum threshold compensates for the fuel Reid Vapor Pressure. As such, when a vacuum is drawn on the fuel tank the reference vacuum threshold can be met during the allotted testing duration if no leak is present. This may reduce false failures and improve the accuracy of the leak test.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example vehicle propulsion system.

FIG. 2 schematically shows an example vehicle system with a fuel system and an evaporative emissions system.

DETAILED DESCRIPTION

Figure 1:
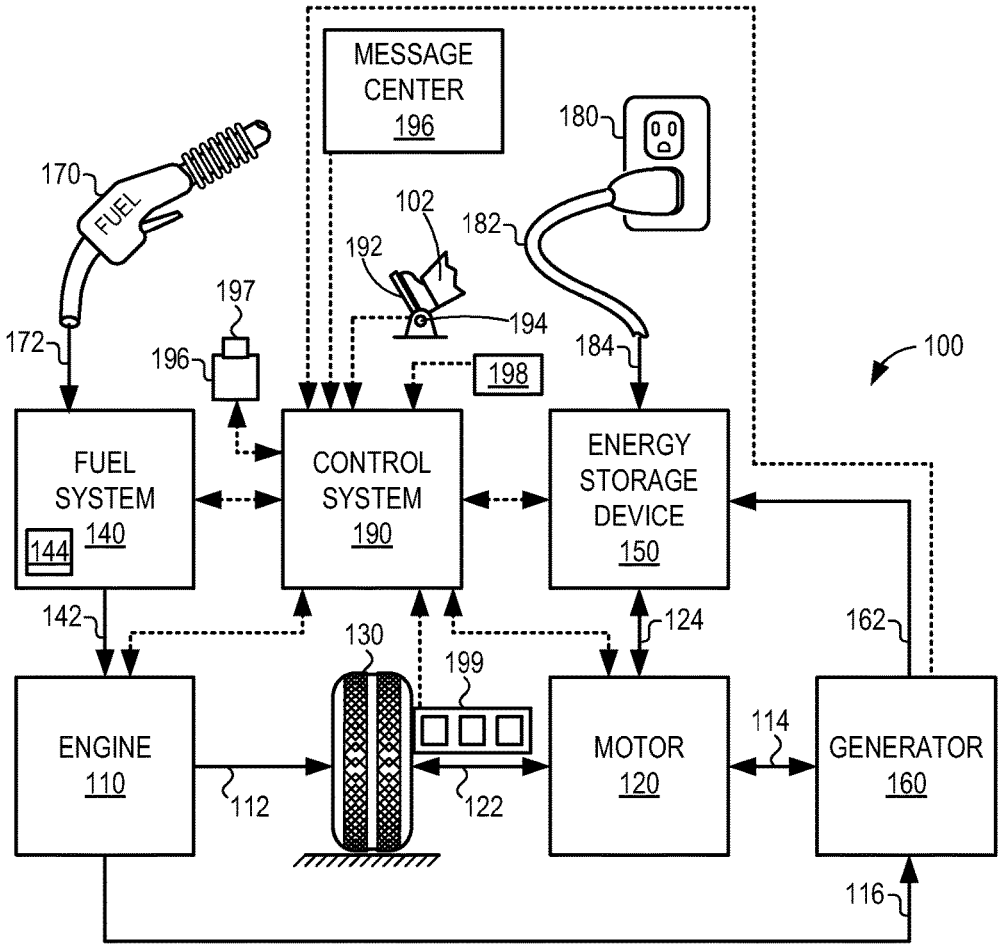
Figure 2:
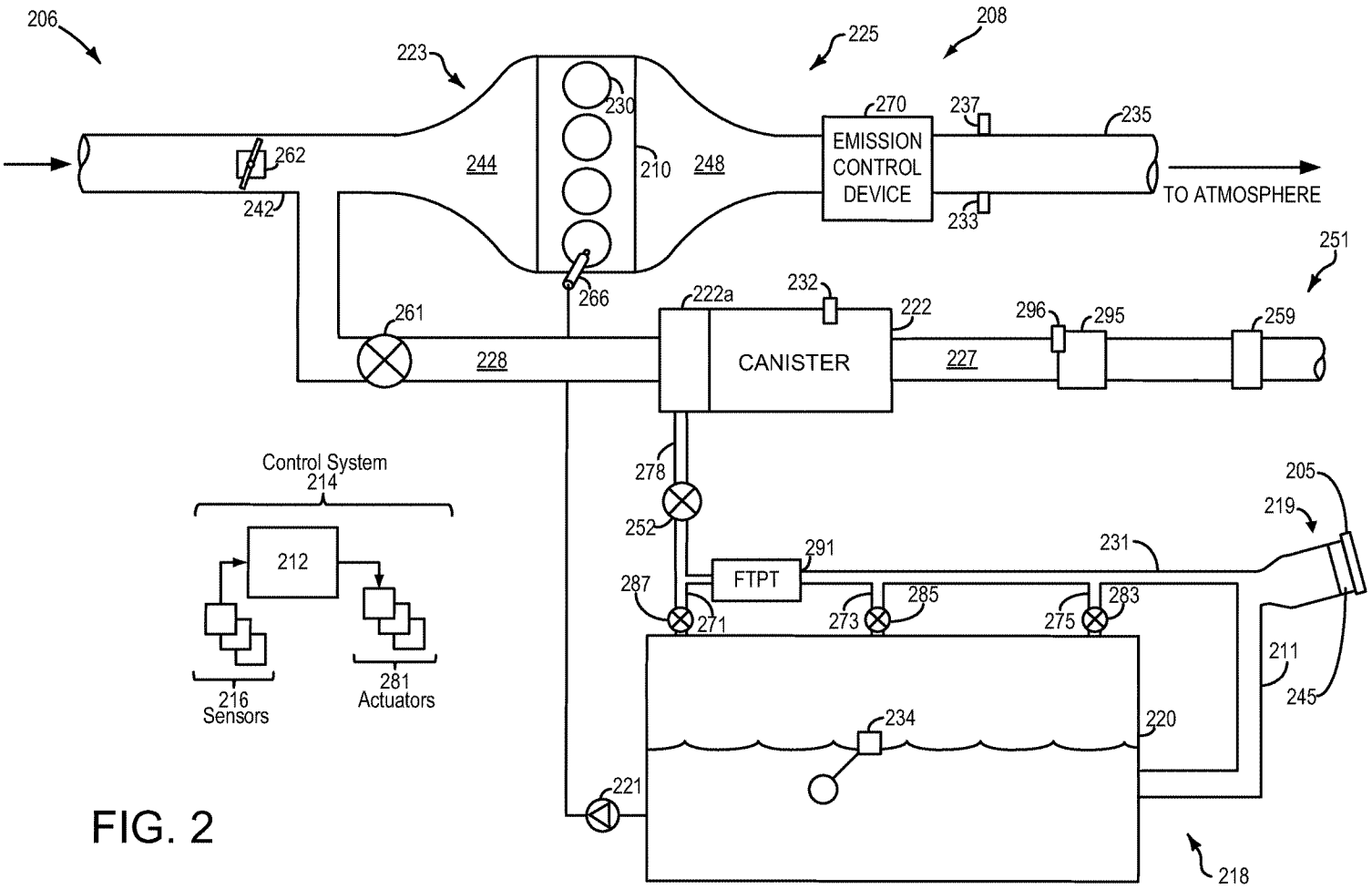
Figure 8:
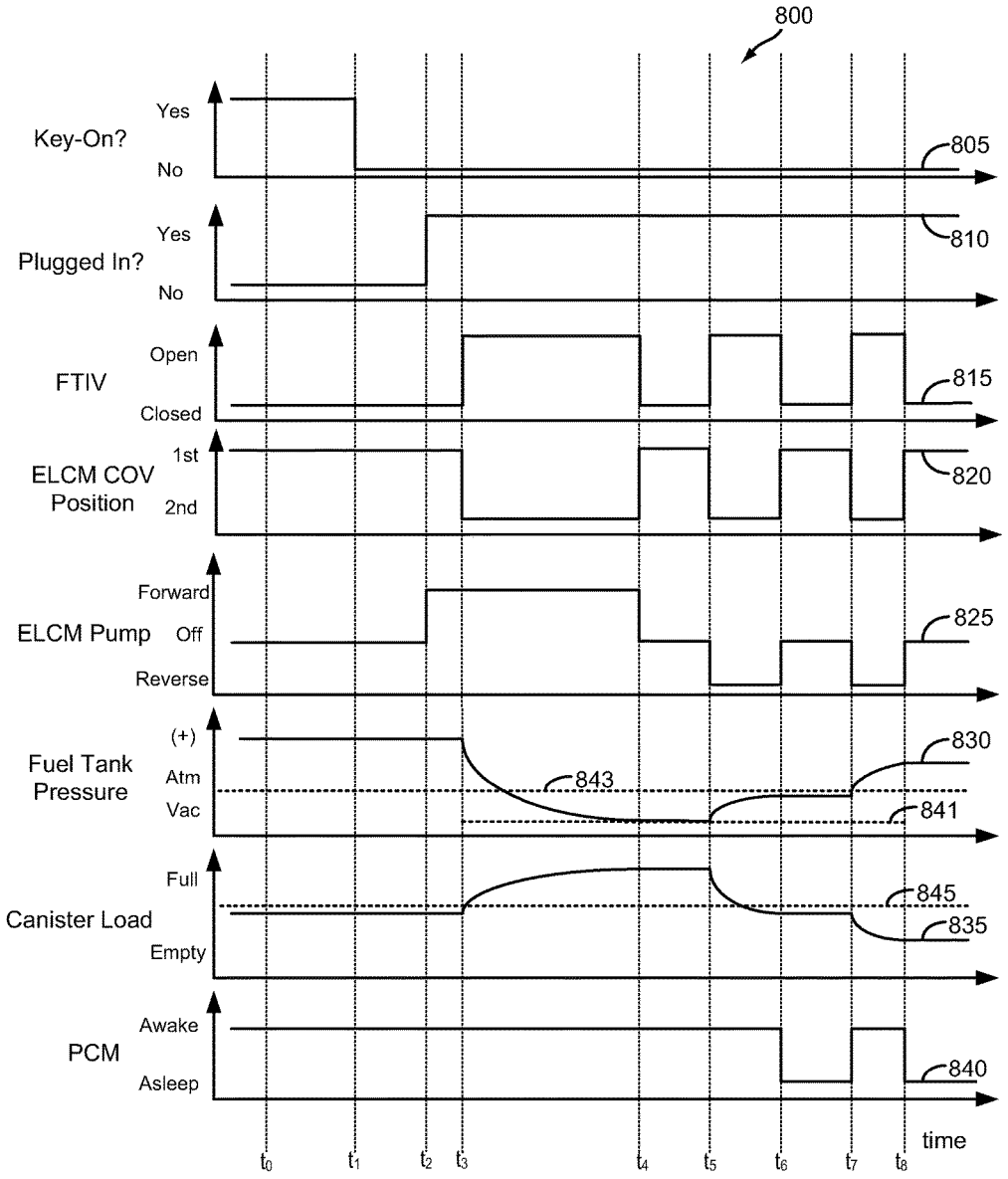
FIG. 8 shows a timeline for an example evaporative leak check module test using the system shown in FIG. 2 and the method shown in FIG. 7.
Figure 9:
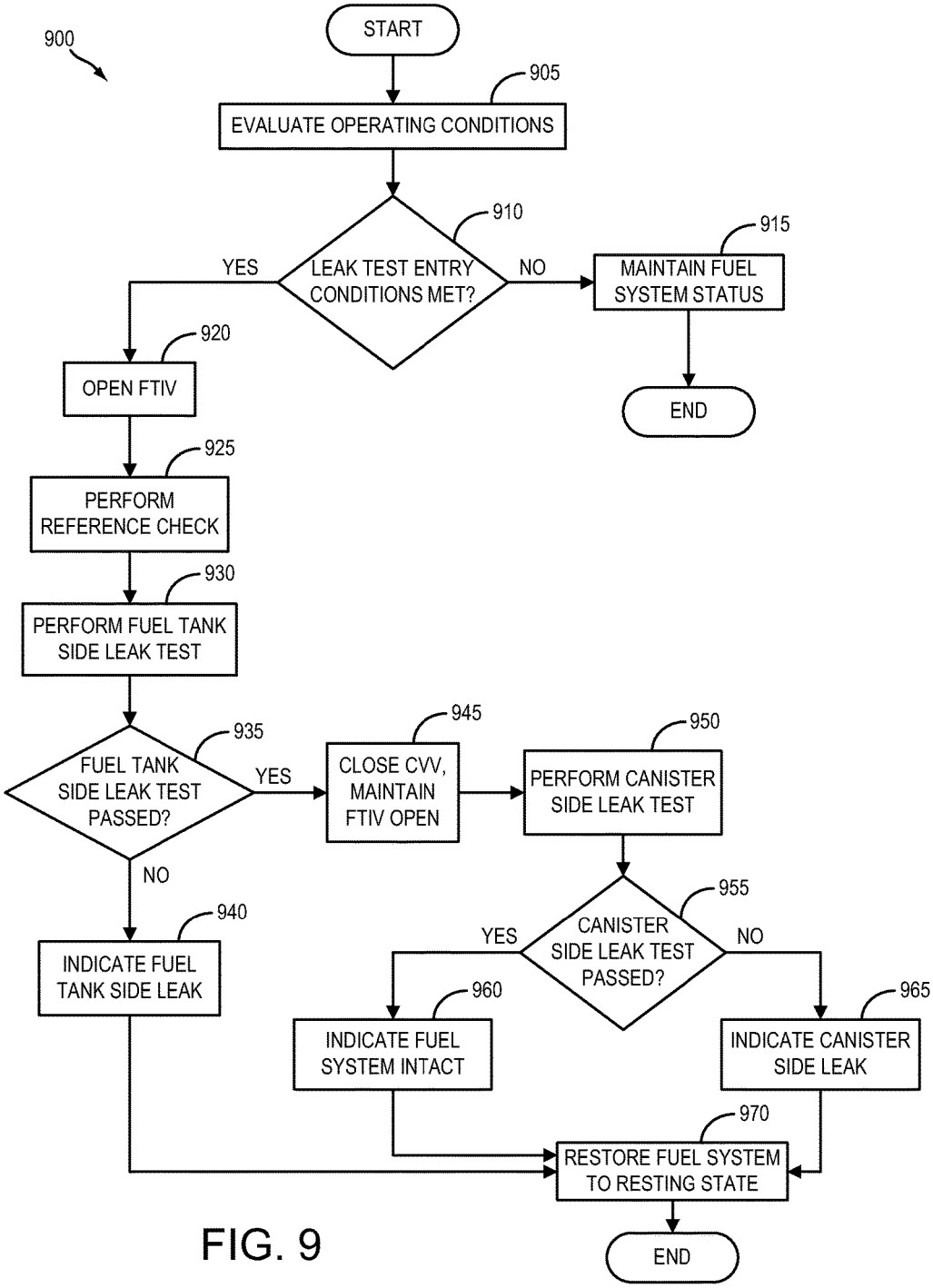
FIG. 9 shows a high level flow chart for a method that may be implemented for performing an evaporative leak check module test that compensates for fuel Reid Vapor Pressure.
Figure 10:
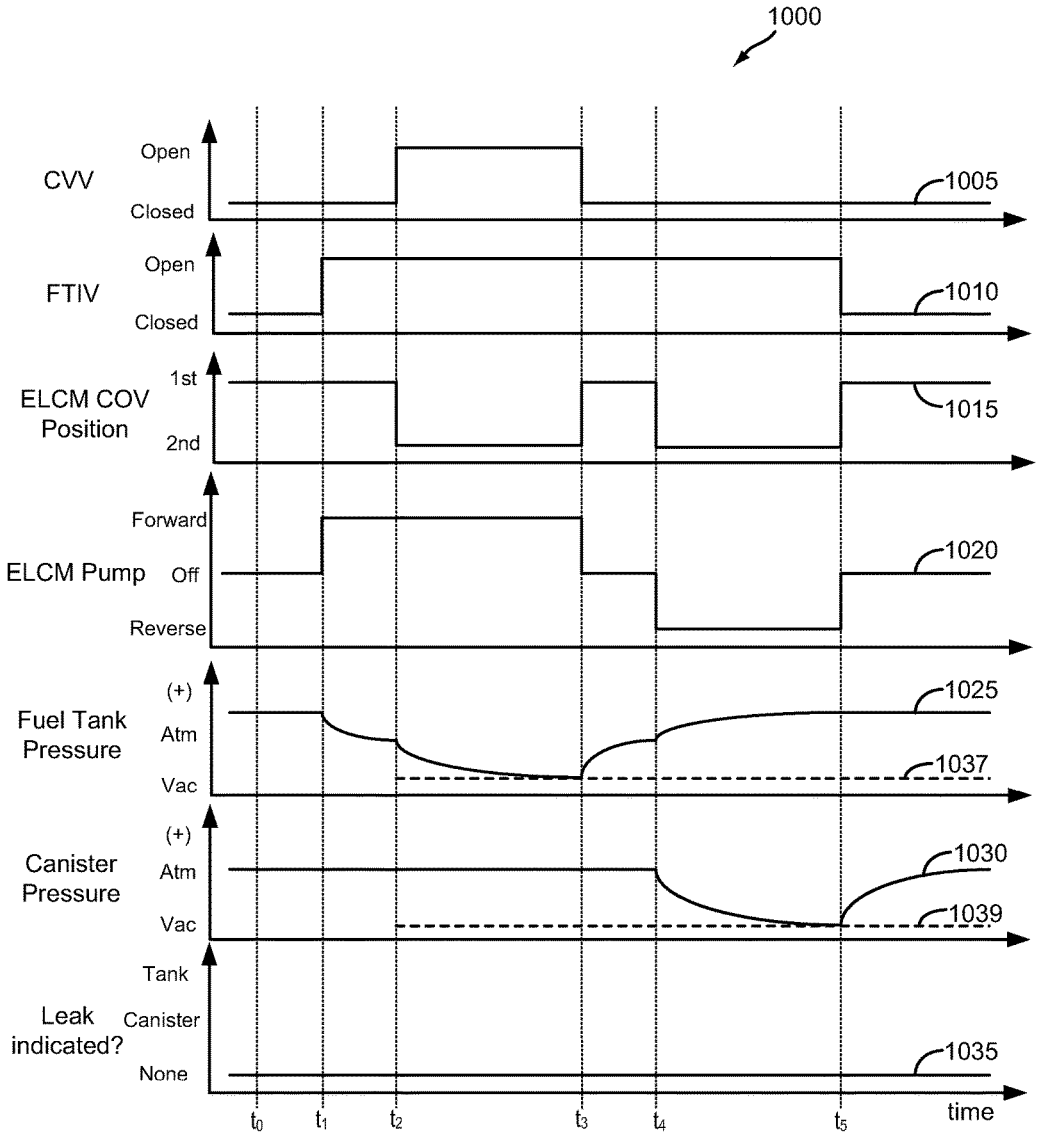
FIG. 10 shows a timeline for an example evaporative leak check module test using the system shown in FIG. 4 and the method shown in FIG. 9.

This detailed description relates to systems and methods for leak testing a fuel system coupled to an engine. The fuel system and engine system may be included in a hybrid vehicle, such as a plug-in electric hybrid vehicle, as depicted in FIG. 1. Hybrid vehicles may be required to include an evaporative leak check module (ELCM) to perform periodic leak tests on the included fuel system. The ELCM may be placed in a vent between the fuel vapor canister and atmosphere, as shown in FIG. 2, or in a conduit between a fuel tank isolation valve (FTIV) and the fuel vapor canister, as shown in FIG. 4. The ELCM may be configured to adapt conformations, such as the conformations shown in FIGS. 3A-3D and 5A-5D. The ELCM may include a reversible vacuum pump configured to operate in a first direction and a second direction, opposite the first direction. The vacuum pump may include a motor that is reversible by means of an H-Bridge circuit, as shown in FIGS. 6A-6B. A controller, or power train control module (PCM) may be configured to perform a control routine for and ELCM test, such as the method depicted in FIG. 7. The method may include determining the integrity of the fuel system by drawing a vacuum on the fuel tank, then reversing the direction of the vacuum pump and purging the contents of the fuel vapor canister back to the fuel tank. FIG. 8 shows an example ELCM test using the method of FIG. 7. FIG. 9 shows an alternative method for determining the integrity of the fuel system depicted in FIG. 4. In this example, the FTIV is opened during the reference vacuum check, thereby allowing the ELCM to compensate for fuel Reid Vapor Pressure. FIG. 10 shows an example ELCM test using the method of FIG. 9.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIGS. 7 and 9, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, and canister temperature sensor 243. Other sensors such as pressure, temperature, air/fuel ratio, and composition sensors may be coupled to various locations in the vehicle system 206. As another example, the actuators may include fuel injector 266, throttle 262, fuel tank isolation valve 252, pump 221, and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 7 and 9.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be coupled in vent 227, between canister 222 and the atmosphere. ELCM 295 may include a vacuum pump for applying negative pressure to the fuel system when administering a leak test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed.

Figure 3A:
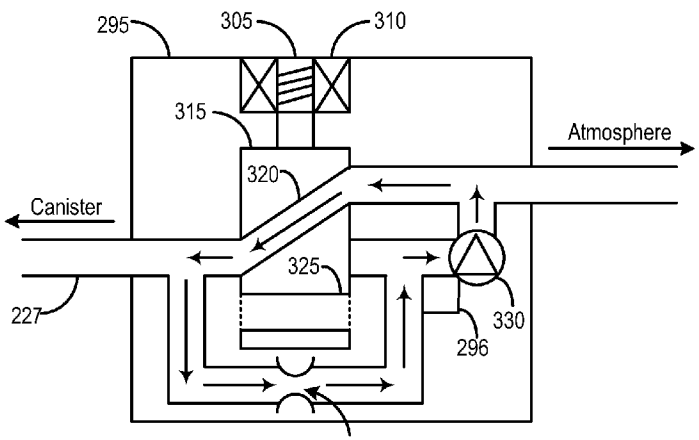
FIG. 3A shows a schematic depiction of an evaporative leak check module in a configuration to perform a reference check.
Figure 3B:
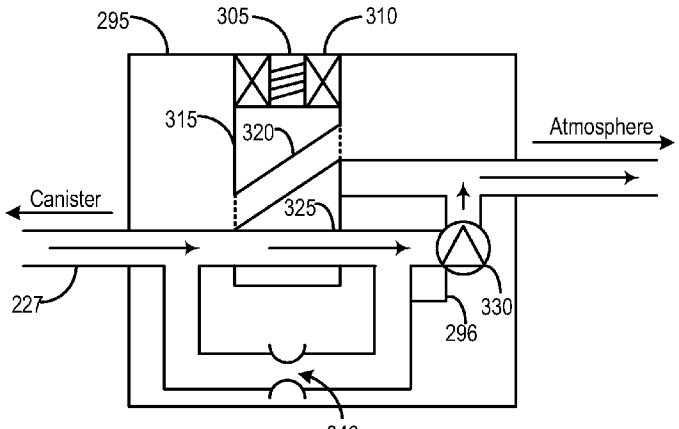
FIG. 3B shows a schematic depiction of an evaporative leak check module in a configuration to perform a fuel system evacuation leak check.
Figure 3C:
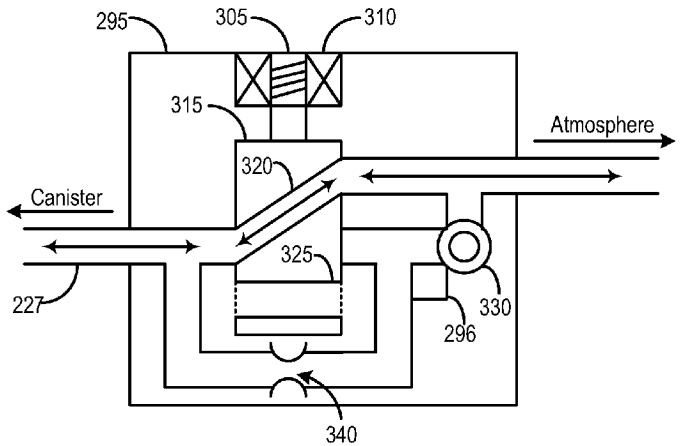
FIG. 3C shows a schematic depiction of an evaporative leak check module in a configuration to perform a purge operation.
Figure 3D:
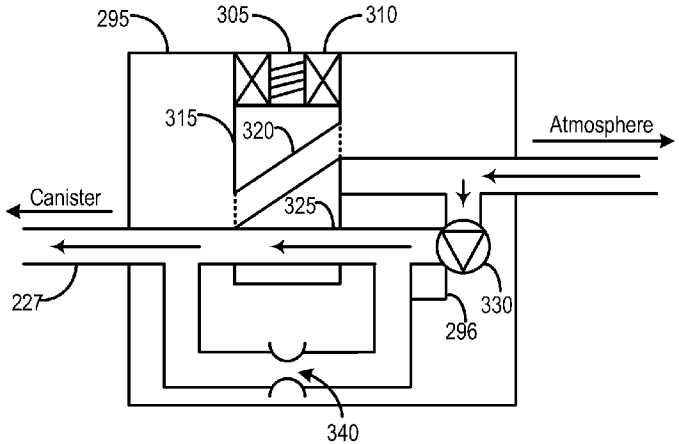
FIG. 3D shows a schematic depiction of an evaporative leak check module in a configuration to perform a passive purge operation.
Figure 4:
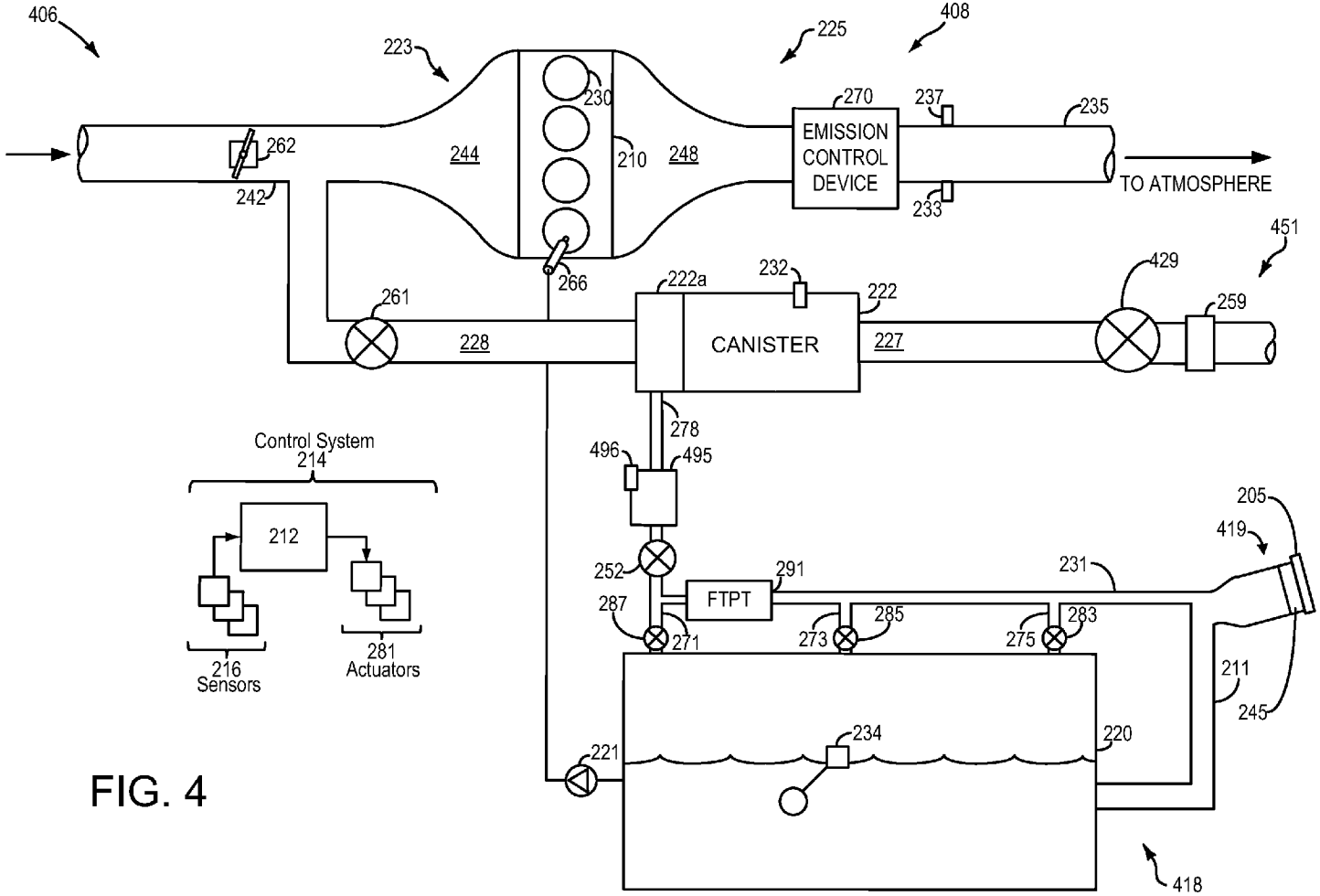
FIG. 4 shows schematically shows an example vehicle system with a fuel system and an evaporative emissions system.

FIGS. 3A-3D show a schematic depiction of an example ELCM 295 in various conditions in accordance with the present disclosure. As shown in FIG. 2, ELCM 295 may be located along vent 227 between canister 222 and atmosphere. ELCM 295 includes a changeover valve (COV) 315, a pump 330, and a pressure sensor 296. Pump 330 may be a reversible pump, for example, a vane pump. COV 315 may be moveable between a first a second position. In the first position, as shown in FIGS. 3A and 3C, air may flow through ELCM 295 via first flow path 320. In the second position, as shown in FIGS. 3B and 3D, air may flow through ELCM 295 via second flow path 325. The position of COV 315 may be controlled by solenoid 310 via compression spring 305. ELCM 295 may also comprise reference orifice 340. Reference orifice 340 may have a diameter corresponding to the size of a threshold leak to be tested, for example, 0.02". In either the first or second position, pressure sensor 296 may generate a pressure signal reflecting the pressure within ELCM 295. Operation of pump 330 and solenoid 310 may be controlled via signals received from controller 212.

As shown in FIG. 3A, COV 315 is in the first position, and pump 330 is activated in a first direction. Fuel tank isolation valve 252 (not shown) is closed, isolating ELCM 295 from the fuel tank. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become the threshold for passing/failing a subsequent leak test.

As shown in FIG. 3B, COV 315 is in the second position, and pump 330 is activated in the first direction. This configuration allows pump 330 to draw a vacuum on fuel system 18. In examples where fuel system 18 includes FTIV 252, FTIV 252 may be opened to allow pump 330 to draw a vacuum on fuel tank 220. Air flow through ELCM 295 in this configuration is represented by arrows. In this configuration, as pump 330 pulls a vacuum on fuel system 218, the absence of a leak in the system should allow for the vacuum level in ELCM 295 to reach or exceed the previously determined vacuum threshold. In the presence of a leak larger than the reference orifice, the pump will not pull down to the reference check vacuum level.

As shown in FIG. 3C, COV 315 is in the first position, and pump 330 is de-activated. This configuration allows for air to freely flow between atmosphere and the canister. This configuration may be used during a canister purging operation, for example.

As shown in FIG. 3D, COV 315 is in the second position, and pump 330 is activated in a second direction, opposite from the first direction. In this configuration, pump 330 may pull air from atmosphere into fuel system 218. In a configuration where FTIV 252 is open and CPV 261 is closed, air drawn by pump 330 may promote desorption of fuel vapor from canister 222, and further direct the desorbed fuel vapor into fuel tank 220. In this way, fuel vapor may be purged from the canister to the fuel tank, thereby decreasing the potential for bleed emissions.

FIG. 4 shows a schematic depiction of a vehicle system 406. Vehicle system 406 is similar to vehicle system 206 as described herein and with regards to FIG. 2. Components that are conserved between vehicle system 206 and vehicle system 406 are indicated with the same numeric identifier. Vehicle system 406 includes an engine system 408 coupled to an emissions control system 451 and a fuel system 418. Fuel system 418 is coupled to refueling system 419.

Flow of air and vapors between canister 222 and the atmosphere may be regulated by a canister vent valve 429. Canister vent valve 429 may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere via canister vent valve 429, or purged to engine intake system 223 via canister purge valve 261.

Fuel system 418 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 and canister vent valve 429 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252 and canister vent valve 429, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 and canister vent valve 429 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Leak detection routines may be intermittently performed by controller 212 on fuel system 418 to confirm that the fuel system is not degraded. Leak tests may be performed by an evaporative leak check module (ELCM) 495 communicatively coupled to controller 212. In contrast to fuel system 218, ELCM 495 may be coupled in conduit 278, between FTIV 252 and canister 222. ELCM 495 may include a vacuum pump for applying negative pressure to the fuel system when administering a leak test. In some embodiments, the vacuum pump may be configured to be reversible. In other words, the vacuum pump may be configured to apply either a negative pressure or a positive pressure on the fuel system. ELCM 495 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed.

As described further herein and with regards to FIG. 5, by coupling ELCM 495 within conduit 278, the fuel Reid Vapor Pressure may be compensated for in the ELCM reference check. By opening FTIV 252 during the reference check stage of a leak test, the vacuum pump of ELCM 495 will be exposed to fuel vapor. This, in turn, may allow for the establishment of a more accurate vacuum threshold that can be compared to the resulting vacuum when the fuel tank is evacuated. By configuring ELCM 495 with a reversible vacuum pump, the leak check module may separately check the fuel tank side and the fuel vapor canister side of fuel system 418 for leaks. By checking the sides separately, a more accurate diagnostic code may be set, allowing for less costly and more rapid leak location and repair.

Figure 5A:
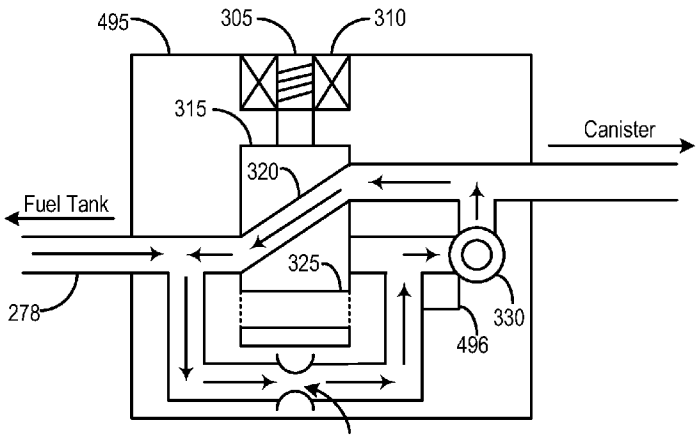
FIG. 5A shows a schematic depiction of an evaporative leak check module in a configuration to perform a reference check accounting for fuel Reid Vapor Pressure.
Figure 5B:
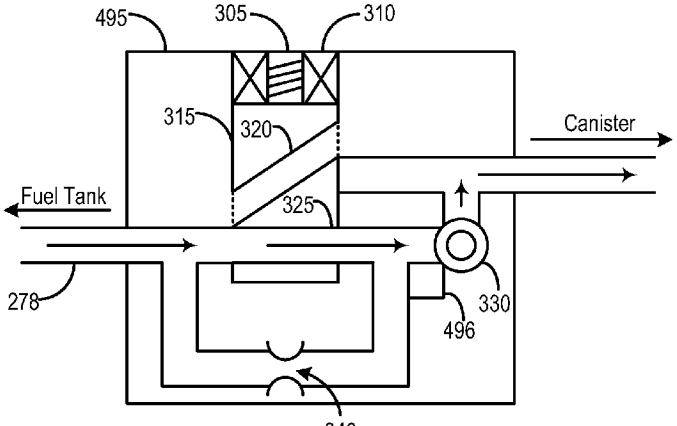
FIG. 5B shows a schematic depiction of an evaporative leak check module in a configuration to perform a fuel tank evacuation leak check.
Figure 5C:
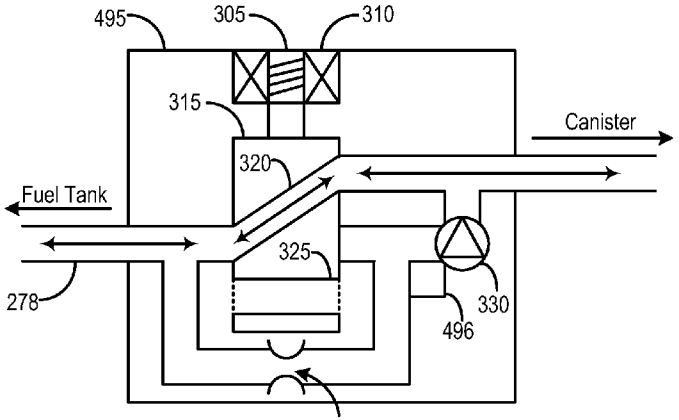
FIG. 5C shows a schematic depiction of an evaporative leak check module in a configuration to perform a purge operation.
Figure 5D:
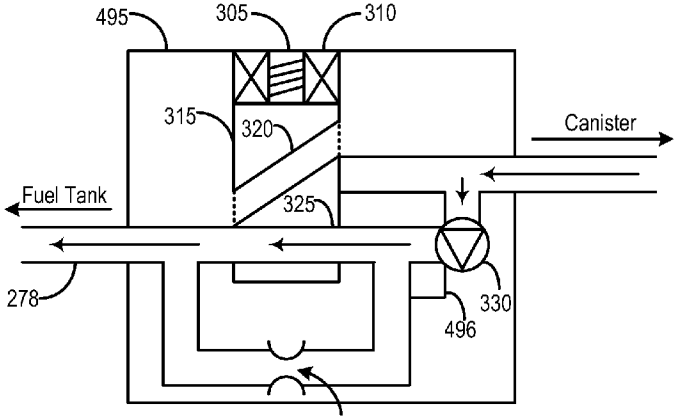
FIG. 5D shows a schematic depiction of an evaporative leak check module in a configuration to perform a fuel vapor canister evacuation leak check.
Figure 6A:
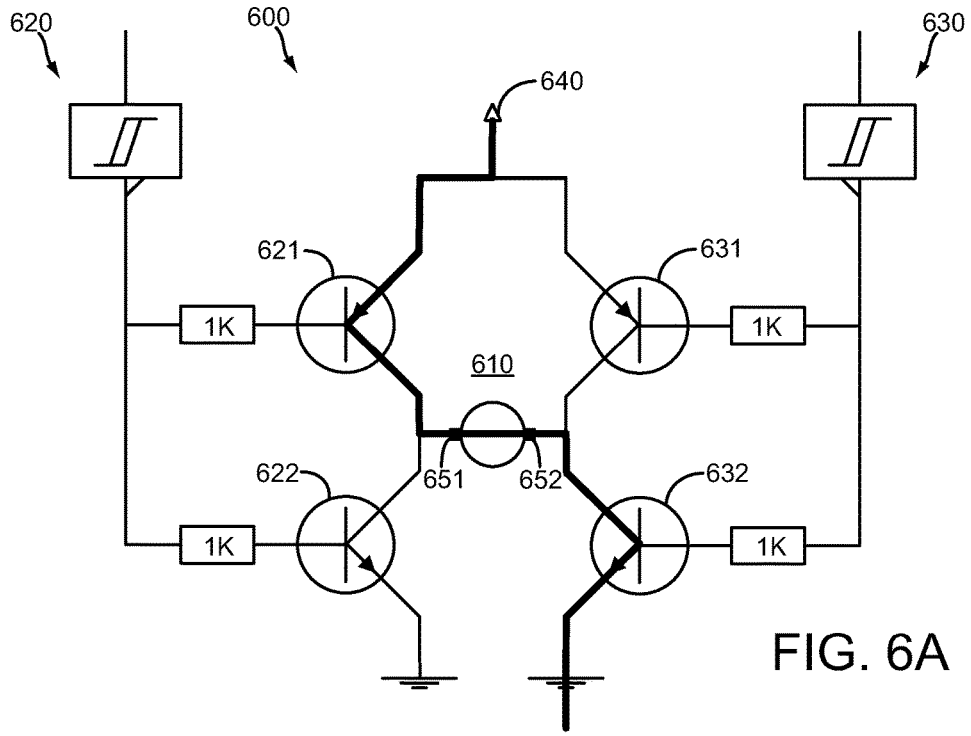
FIGS. 6A and 6B show a schematic depiction of an electronic circuit configured to reverse the orientation of a leak check module vacuum pump.
Figure 6B:
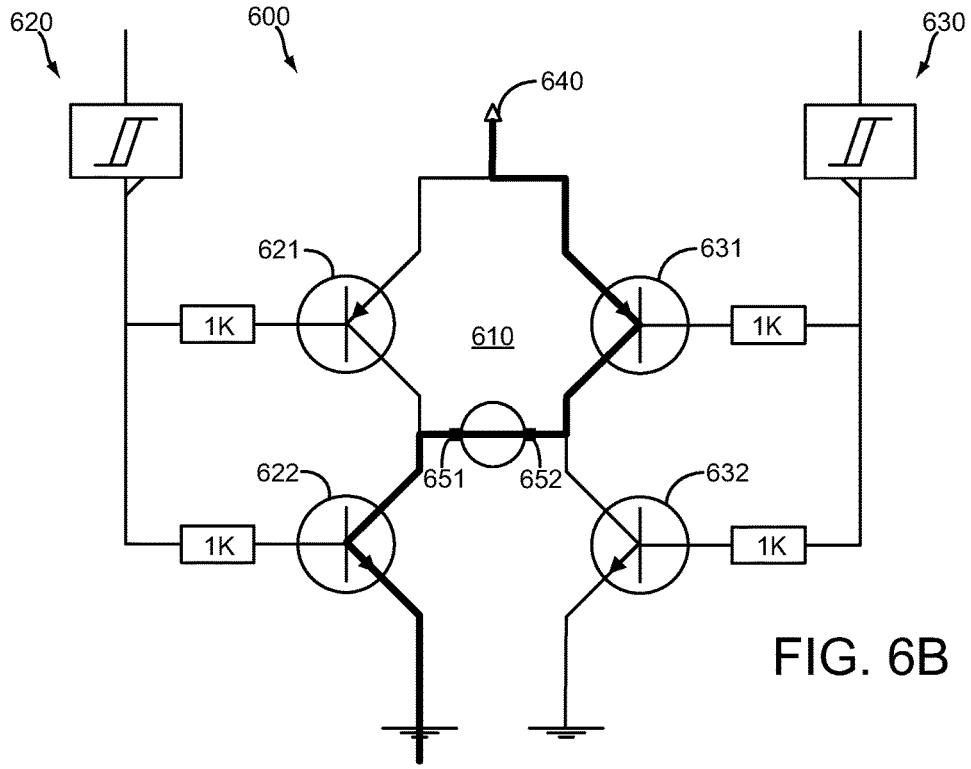

FIGS. 5A-5D show a schematic depiction of an example ELCM 495 in various conditions in accordance with the present disclosure. As shown in FIG. 4, ELCM 495 may be located along conduit 278 between canister 222 and FTIV 252. ELCM 495 includes a changeover valve (COV) 315, a pump 330, and a pressure sensor 496. Pump 330 may be a reversible pump, for example, a vane pump. COV 315 may be moveable between a first a second position. In the first position, as shown in FIGS. 5A and 5C, air may flow through ELCM 495 via first flow path 320. In the second position, as shown in FIGS. 5B and 5D, air may flow through ELCM 495 via second flow path 325. The position of COV 315 may be controlled by solenoid 310 via compression spring 305. ELCM 495 may also comprise reference orifice 340. Reference orifice 340 may have a diameter corresponding to the size of a threshold leak to be tested, for example, 0.02". In either the first or second position, pressure sensor 496 may generate a pressure signal reflecting the pressure within ELCM 495. Operation of pump 330 and solenoid 310 may be controlled via signals received from controller 12.

As shown in FIG. 5A, COV 315 is in the first position, and pump 330 is activated in a first direction. Air flow through ELCM 495 in this configuration is represented by arrows. In this configuration, pump 330 may draw a vacuum on reference orifice 340, and pressure sensor 496 may record the vacuum level within ELCM 495. This reference check vacuum level reading may then become the threshold for passing/failing a subsequent leak test. In a configuration where FTIV 252 (not shown) is open, fuel vapor from the fuel tank may reach reference orifice 340, allowing for the reference check to internally compensate for fuel Reid Vapor Pressure. In a configuration where FTIV 252 is closed, the reference check will be compensated for atmospheric air, but not fuel vapor.

As shown in FIG. 5B, COV 315 is in the second position, and pump 330 is activated in the first direction. When FTIV 252 is opened, pump 330 may draw a vacuum on fuel tank 220. Air flow through ELCM 495 in this configuration is represented by arrows. In this configuration, as pump 330 pulls a vacuum on fuel tank 220, the absence of a leak in the fuel tank should allow for the vacuum level in ELCM 495 to reach or exceed the previously determined vacuum threshold. In the presence of a leak larger than the reference orifice, the pump will not pull down to the reference check vacuum level.

As shown in FIG. 5C, COV 315 is in the first position, and pump 330 is de-activated. If FTIV 252 is open, this configuration allows for air and fuel vapor to freely flow between fuel tank 220 and canister 222. This configuration may be used during a fuel tank depressurization operation, for example.

As shown in FIG. 5D, COV 315 is in the second position, and pump 330 is activated in a second direction, opposite from the first direction. In a configuration where CPV 261 and CVV 429 are both closed, pump 330 may pull a vacuum on the canister side of fuel system 418. The absence of a leak on the canister side should allow for the vacuum level in ELCM 495 to reach or exceed the previously determined vacuum threshold. In the presence of a leak larger than the reference orifice, the pump will not pull down to the reference check vacuum level. In a configuration where CPV 261 is closed, CVV 429 is open, and FTIV 252 is open, air drawn by pump 330 via vent 227 may promote desorption of fuel vapor from canister 222, and further direct the desorbed fuel vapor into fuel tank 220. In this way, fuel vapor may be purged from the canister to the fuel tank, thereby decreasing the potential for bleed emissions.

FIGS. 6A and 6B show an example circuit 600 that may be used for reversing a pump motor of ELCM pump 330. Circuit 600 schematically depicts an H-Bridge circuit that may be used to run a motor 610 in a first (forward) direction and alternately in a second (reverse) direction. Circuit 600 comprises a first (LO) side 620 and a second (HI) side 630. Side 620 includes transistors 621 and 622, while side 630 includes transistors 631 and 632. Circuit 600 further includes a power source 640.

In FIG. 6A, transistors 621 and 632 are activated, while transistors 622 and 631 are turned off. In this confirmation, the left lead 651 of motor 610 is connected to power source 640, and the right lead 652 of motor 610 is connected to ground. In this way, motor 600 may run in a forward direction.

In FIG. 6B, transistors 622 and 631 are activated, while transistors 621 and 632 are turned off. In this confirmation, the right lead 652 of motor 610 is connected to power source 640, and the left lead 651 of motor 610 is connected to ground. In this way, motor 600 may run in a reverse direction.

Figure 7:
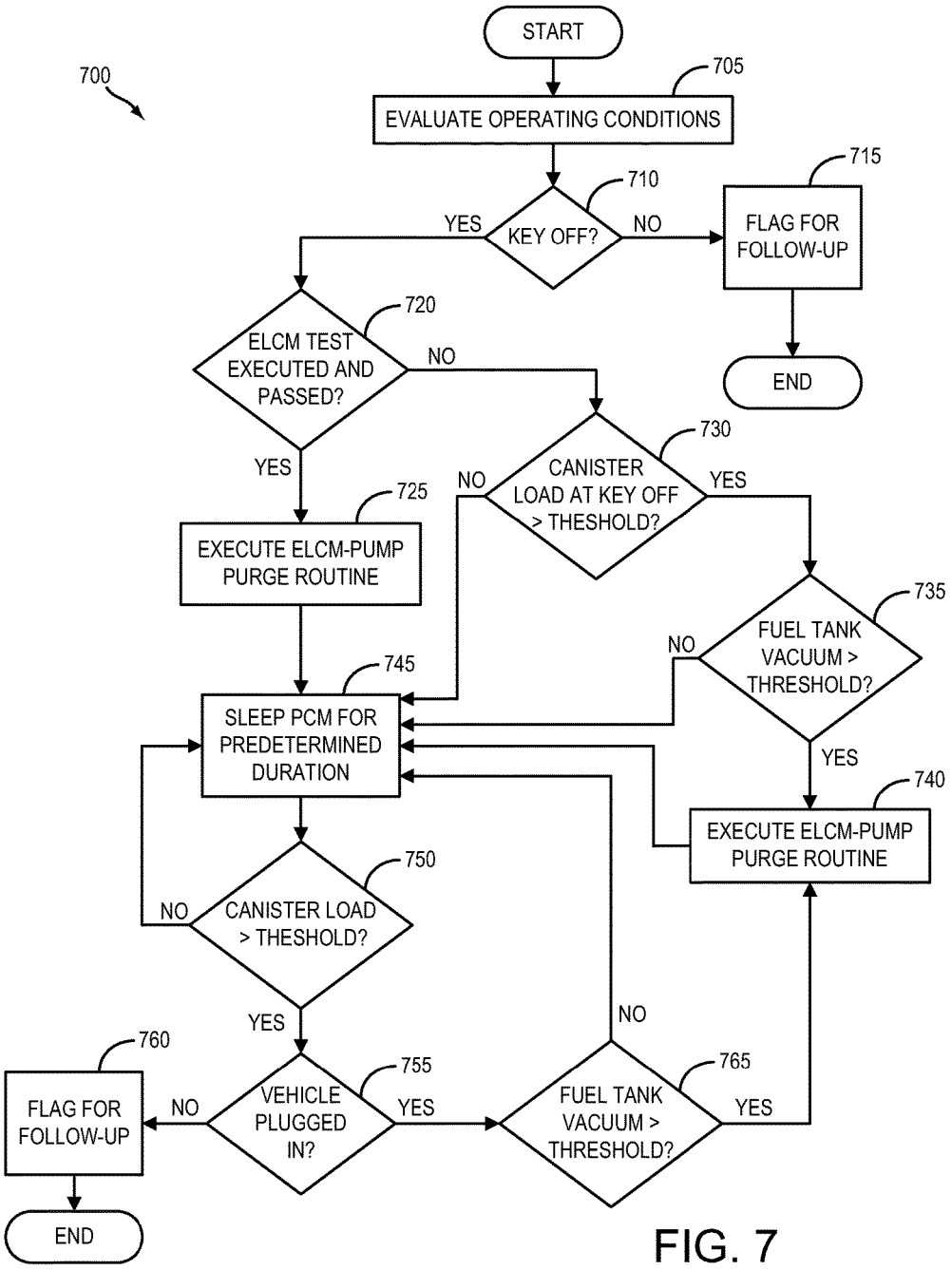
FIG. 7 shows a high level flow chart for a method that may be implemented for performing an evaporative leak check module test and passive purge routine.

FIG. 7 shows a high level flow chart for an example method 700 for a leak test utilizing a dual-function ELCM in a plug-in hybrid vehicle in accordance with the present disclosure. Method 700 will be described with relation to the systems depicted in FIGS. 1, 2, and 3A-D, but it should be understood that similar methods may be used with other systems without departing from the scope of this disclosure. Method 700 may be stored as instructions in non-transitory memory and carried out by controller 212.

Method 700 may begin at 705 by estimating operating conditions. Operating conditions may include ambient conditions, such as temperature, humidity, and barometric pressure, as well as vehicle conditions, such as engine operating status, fuel level, fuel tank pressure, fuel vapor canister load status, etc. Continuing at 710, method 700 may include determining whether the vehicle is in a key-off state. If the vehicle is not in a key-off state, method 700 may proceed to 715. At 715, method 700 may include setting a follow-up flag. A follow-up flag may be stored in controller 212, and may indicate that method 700 is to be initiated again, for example, when the key-off state is met, or after a predetermined duration. The status of the fuel system may otherwise be maintained. Method 700 may then end.

If the key-off state is met, method 700 may proceed to 720. At 720, method 700 may include determining whether an ELCM test has been executed and passed within a predetermined duration. For example, method 700 may determine whether an ELCM test has been executed in the time period following the key-off event, and/or in the time period following a most recent engine-off event. In some examples, method 700 may be initiated following an ELCM test. If method 700 is initiated during an ELCM test, or if an ELCM test is scheduled to be initiated while the vehicle is in the key-off state, method 700 may be suspended, or may be flagged for follow up.

If it is determined at 720 that an ELCM test has been executed and passed, method 700 may proceed to 725. At 725, method 700 may include executing an ELCM-pump based purge routine. During an ELCM test, fuel vapor may be drawn from fuel tank 220 into fuel vapor canister 222. Allowing a full vapor canister to undergo a diurnal cycle during a key-off state may lead to an increase in bleed emissions. The ELCM-pump based purge routine may include placing changeover valve 315 in the $2^{nd}$ position and activating pump 330 in a $2^{nd}$ (reverse) direction, as described herein and with regards to FIG. 3D. FTIV 252 may be opened, and CPV 261 may be closed. In this configuration, reversible ELCM pump 330 may be used to draw fresh air through vent 227, desorbing fuel vapors from canister 222, and returning the fuel vapors to fuel tank 220. Following an ELCM test, the fuel tank may hold a vacuum, which may facilitate air flow through the fuel canister, and further facilitate flow of desorbed fuel vapor into the fuel tank. In this way, the vacuum pump run time may be limited while the vehicle is in a key-off state. The purge routine may be executed for a predetermined duration, a duration based on canister load, or may be executed until a threshold is reached, for example, a fuel tank pressure threshold. The purge routine may end with the turning off of ELCM pump 330, the closing of FTIV 252, and the placing of COV 315 in the first position. Method 700 may then proceed to 745.

If it is determined at 720 that an ELCM test has not been executed (or executed and failed), method 700 may proceed to 730. At 730, method 700 may include determining whether the canister load at key-off is above a threshold. Canister load may be determined empirically, or inferred. For example, changes in canister temperature as determined by canister temperature sensor 232 may be used to determine the amount of fuel vapor adsorbed to the canister, and/or the amount of fuel vapor desorbed during a purge routine. If the canister load at key-off is not above the load threshold, method 700 may proceed to 745.

If the canister load at key-off is above the load threshold, method 700 may proceed to 735. At 735, method 700 may include determining whether a fuel tank vacuum is above a threshold. Fuel tank vacuum may be determined via one or more fuel tank pressure sensors, such as FTPT 291. If fuel tank vacuum is not above a threshold, method 700 may proceed to 745. If the fuel tank vacuum is above a threshold, method 700 may proceed to 740. At 740, method 700 may include executing an ELCM-pump based purge routine, as described at 725. Following the completion of the purge routine, method 700 may proceed to 745.

At 745, method 700 may include setting the controller or PCM to sleep for a predetermined duration. While the vehicle is in key-off mode, changes in vehicle temperature (following an engine-off event), and changes in ambient temperature (over a diurnal cycle) may cause the fuel tank pressure to increase or decrease. An increase in fuel tank pressure may force some fuel vapor through the sealed fuel tank isolation valve and into the fuel vapor canister. Further, fuel vapor stored in the fuel vapor canister can migrate towards the fresh-air side of the canister, increasing bleed emissions. By sleeping the PCM for a duration, conditions can be evaluated after the PCM is re-awoken to determine whether an ELCM-purge routine is favorable.

When the PCM has been re-awoken, method 700 may proceed to 750. At 750, method 700 may include determining whether the canister load is above a threshold. If the canister load is not above a threshold, method 700 may return to 745, and return the PCM to sleep for the predetermined duration. If the canister load is above the threshold, method 700 may proceed to 755. At 755, method 700 may include determining whether the vehicle is plugged in, or otherwise coupled to a power source. If the vehicle is not coupled to a power source, method 700 may proceed to 760, method 700 may include setting a follow-up flag. The status of the fuel system may otherwise be maintained. Method 700 may then end.

If the vehicle is coupled to a power source, method 700 may proceed to 765. At 765, method 700 may include determining whether the fuel tank vacuum is above a threshold. If the fuel tank vacuum is not above a threshold, method 700 may return to 745, and return the PCM to sleep for the predetermined duration. If the fuel tank vacuum is above the threshold, method 700 may proceed to 740. At 740, method 700 may include executing the ELCM-pump based purge routine. Following the completion of the purge routine, method 700 may proceed to 745, and return the PCM to sleep for the predetermined duration.

The systems described herein and depicted in FIGS. 1, 2, 3A-3D and 6A-B, along with the method described herein and depicted in FIG. 7 may enable one or more systems and one or more methods. A fuel system for a vehicle, comprising: a fuel tank coupled to a fuel vapor canister via a fuel tank isolation valve; an evaporative leak check module coupled between the fuel vapor canister and atmosphere, the evaporative leak check module comprising a reversible vacuum pump; and a control system configured with instructions stored in non-transitory memory, that when executed cause the control system to: determine a reference vacuum threshold; then open a fuel tank isolation valve; determine a first fuel system pressure by drawing a vacuum on the fuel system via operating the reversible vacuum pump in a first direction; indicate a fuel system leak based on a comparison of the first fuel system pressure and the reference vacuum threshold; then purge contents of the fuel vapor canister to the fuel tank by operating the reversible vacuum pump in a second direction, opposite the first direction, while maintaining the fuel tank isolation valve open. The evaporative leak check module may further comprise a reference orifice and a changeover valve operable between a first position and a second position, and where determining a reference vacuum threshold further comprises: placing the changeover valve in the first position; and drawing a vacuum on the reference orifice by operating the reversible vacuum pump in the first direction. Drawing a vacuum on the fuel system may further comprise: placing the changeover valve in the second position. Purging contents of the fuel vapor canister to the fuel tank further comprises: placing the changeover valve in the second position. In some examples, the vehicle may be a plug-in hybrid vehicle, and the control system may be further configured with instructions stored in non-transitory memory, that when executed cause the control system to: following purging contents of the fuel vapor canister to the fuel tank, close the fuel tank isolation valve; turn off the vacuum pump; sleep the control system for a predetermined duration; then wake the control system; and during a first condition, comprising a fuel tank vacuum greater than a vacuum threshold, a canister load greater than a load threshold, and a vehicle status where the vehicle is coupled to an external power source: open the fuel tank isolation valve; purge the fuel vapor canister to the fuel tank by running the vacuum pump in the second direction. The technical result of implementing this method is a reduction in the resting canister load in hybrid vehicles, which may otherwise go for long periods without an opportunity to purge the canister to intake. Evaporative emissions regulations require testing of the fuel system, which may draw fuel vapor into the canister even if the engine is not in use. By incorporating a reversible vacuum pump, the canister can be cleaned, and fuel vapor returned to the fuel tank. For plug-in hybrids, power from an external power source may be used to drive the vacuum pump, thereby purging the canister contents without draining the vehicle battery.

FIG. 8 shows an example timeline 800 for a leak test utilizing a dual-function ELCM in a plug-in hybrid vehicle using the method described herein and with regards to FIG. 7 as applied to the system described herein and with regards to FIGS. 1, 2, and 3A-D. Timeline 800 includes plot 805 indicating the key-on status of a PHEV over time. Timeline 800 further includes plot 810 indicating the plugged-in status of the PHEV over time. Timeline 800 further includes plot 815, indicating the status of a fuel tank isolation valve over time; plot 820, indicating the status of an ELCM changeover valve over time; plot 825, indicating the status of an ELCM vacuum pump over time; plot 830, indicating pressure in a fuel tank over time; plot 835, indicating a fuel vapor canister load over time, and plot 840, indicating the status of a powertrain control module (PCM) over time. Line 841 represents a vacuum threshold for a 0.02" leak based on an ELCM reference check. Line 843 represents a threshold fuel tank vacuum for performing ELCM-pump based canister purge routine. Line 845 represents a threshold canister load.

At time $t_0$, the vehicle is in a key-on mode, as shown by plot 805. Accordingly, the FTIV is closed, the ELCM COV is in the first position, and the ELCM pump is off, as shown by plots 815, 820, and 825, respectively. At time $t_1$, the vehicle is placed in a key-off mode, as shown by plot 805. The statuses of the FTIV, ELCM COV, and ELCM pump are maintained. The CPV may be considered to be maintained closed throughout timeline 800.

At time $t_2$, conditions for a leak test are met. Accordingly, the ELCM pump is turned on in the forward direction, as shown by plot 825, while the ELCM COV remains in the $1^{st}$ position, and the FTIV remain closed, as shown by plots 820 and 815, respectively. In this configuration, the ELCM draws a vacuum through its internal reference orifice, allowing a vacuum reference to be established for a leak with an equivalent diameter to the reference orifice (0.02" in this example). As such, the fuel tank pressure and canister load remain constant, even with the pump on, as shown by plots 830 and 835, respectively. The vehicle is also plugged in to a power grid at time $t_2$, as shown by plot 810.

At time $t_3$, the reference check is completed, and a vacuum threshold for the leak check is established, indicated by line 841. The leak test may then begin. The ELCM pump remains on, as indicated by plot 825, and the ELCM COV is moved to the second position via the energizing of the ELCM solenoid, as shown by plot 820. The FTIV is opened, as shown by plot 815, allowing for the ELCM pump to draw a vacuum on the fuel tank. From time $t_3$ to time $t_4$, the fuel tank pressure drops, as shown by plot 830, until the fuel tank pressure reaches the vacuum reference shown by line 841. With the fuel tank pressure reaching the vacuum reference at time $t_4$, the integrity of the fuel system is confirmed, and the leak test may end. As a vacuum is drawn on the fuel tank, fuel vapor is directed into the fuel vapor canister, as shown by plot 835.

At time $t_4$, with the leak test completed, the FTIV is closed, as shown by plot 815, trapping a vacuum in the fuel tank, as shown by plot 830. The ELCM COV is returned to the first position, and the ELCM pump is shut off, as shown by plots 820 and 825, respectively.

A time $t_5$, conditions are met for an ELCM-pump based purge operation, which runs from time $t_5$ to time $t_6$. The FTIV is opened, the ELCM COV is placed in the second position, and the ELCM pump is turned on in the reverse direction, as shown by plots 815, 820, and 825, respectively. In this configuration, fresh air is drawn through the vent line, desorbing fuel vapor from the fuel vapor canister, and returning the fuel vapor to the fuel tank. Accordingly, the fuel tank pressure increases, as shown by plot 830, while the canister load decreases, as shown by plot 835. At time $t_6$, the ELCM-pump based purge operation ends. The FTIV is closed, the ELCM COV is placed in the first position, and the ELCM pump is turned off, as shown by plots 815, 820, and 825, respectively.

From time $t_6$ to time $t_7$, the vehicle PCM may be placed in a sleep mode, as indicated by plot 840. At time $t_7$, the PCM is re-awoken, and conditions are met for another ELCM-pump based purge routine, as the fuel tank vacuum is above the threshold indicated by line 843, the canister load is above the threshold indicated by line 845, and the vehicle is plugged into a power grid, as shown by plot 810. An ELCM-pump based purge routine is run from time $t_7$ to time $t_8$ mirroring the conditions described for time $t_5$ to time $t_6$. The fuel tank pressure increases, as shown by plot 830 and the canister load decreases, as shown by plot 835. At time $t_8$, the fuel system is returned to a resting state (e.g. FTIV closed, ELCM COV in $1^{st}$ position, ELCM pump off), and the PCM is returned to sleep mode.

FIG. 9 shows a high level flow chart for an example method 900 for utilizing a dual-function ELCM in a hybrid vehicle in accordance with the present disclosure. Method 700 will be described with relation to the systems depicted in FIGS. 1, 4, and 5A-D, but it should be understood that similar methods may be used with other systems without departing from the scope of this disclosure. Method 900 may be stored as instructions in non-transitory memory and carried out by controller 212.

Method 900 may begin at 905 by estimating operating conditions. Operating conditions may include ambient conditions, such as temperature, humidity, and barometric pressure, as well as vehicle conditions, such as engine operating status, fuel level, fuel tank pressure, fuel vapor canister load status, etc. Continuing at 910, method 900 may include determining whether the entry conditions are met for an ELCM-based leak test. For example, entry conditions may include an engine-off condition, and/or an elapsed duration or number of engine-off events following a previous ELCM-based fuel system leak test. If entry conditions are not met, method 900 may proceed to 915. At 915, method 900 may include maintaining the status of the vehicle fuel system. A flag may be set at controller 212 to follow up at a subsequent key-off event, and/or when operating conditions favor a leak test. Method 900 may then end.

If entry conditions for a leak test are met, method 900 may proceed to 920. At 920, method 900 may include opening FTIV 252, thereby exposing ELCM 495 to fuel vapor from the fuel tank. Continuing at 930, method 900 may include performing an ELCM reference check. As discussed herein with regards to FIG. 5A, an ELCM reference check may comprise closing (or maintaining closed) canister vent valve 429, placing COV 315 in a first position, and activating ELCM vacuum pump 330 in a first (forward) direction. A pressure sensor, such as pressure sensor 496 may record the resulting vacuum level in the ELCM, after a certain amount of time, or when the vacuum level has reached a plateau. The recorded vacuum level at the end of the reference check may be used as a vacuum threshold to signify the expected vacuum attainable for a systemic leak with a diameter equivalent to the reference orifice. In this example, the reference orifice has a diameter of 0.02", but may be smaller or greater in diameter in some embodiments.

Continuing at 930, method 900 may include performing a fuel tank side leak test. As discussed herein with regards to FIG. 5B, a fuel tank side leak test may comprise opening CVV 429, placing COV 315 in a second position, maintaining FTIV 252 open, and maintaining ELCM vacuum pump 330 on in a first (forward) direction. In this configuration, as pump 330 pulls a vacuum on fuel tank 220, the absence of a leak in the system should allow for the vacuum level in ELCM 495 to reach or exceed the previously determined vacuum threshold. In the presence of a leak larger than the reference orifice, the pump will not pull down to the reference check vacuum level. The pull down may be executed until the reference vacuum is met, for a time period that is predetermined, or for a time period based on current conditions. Continuing at 935, method 900 may include determining whether the fuel tank side leak test has passed. The pass/fail nature of the leak test may be determined by whether the reference is met during the fuel tank vacuum pull down. If the fuel tank leak test is not passed, method 900 may proceed to 940. At 940, method 900 may include indicating a fuel tank side leak. Indicating a fuel tank side leak may include recording the occurrence of a failing test result, and may further include illuminating an MIL. Method 900 may then proceed to 970.

If the fuel tank leak test is passed, method 900 may proceed to 945. At 945, method 900 may include closing CVV 429, and may further include maintaining FTIV 252 open. CPV 261 may also be maintained closed. Continuing at 950, method 900 may include performing a canister side leak test. As discussed herein with regards to FIG. 5D, a canister side leak test may comprise placing (or maintaining) COV 315 in a second position, and activating ELCM vacuum pump 330 on in a second (reverse) direction. In this configuration, as pump 330 pulls a vacuum on canister 222, vent 227 and purge line 228, the absence of a leak in the system should allow for the vacuum level in ELCM 495 to reach or exceed the previously determined vacuum threshold. In the presence of a leak larger than the reference orifice, the pump will not pull down to the reference check vacuum level. The pull down may be executed until the reference vacuum is met, for a time period that is predetermined, or for a time period based on current conditions.

Continuing at 955, method 900 may include determining whether the canister side leak test has passed. The pass/fail nature of the leak test may be determined by whether the reference is met during the fuel tank vacuum pull down. If the canister side leak test passed, method 900 may proceed to 960. At 940, method 900 may include indicating the fuel system is intact. Indicating the fuel system is intact may include recording the occurrence of a passing test result. Method 900 may then proceed to 970. If the canister side leak test is not passed, method 900 may proceed to 965. At 965, method 900 may include indicating a canister side leak. Indicating a canister side leak may include recording the occurrence of a failing test result, and may further include illuminating an MIL. Method 900 may then proceed to 970.

At 970, method 900 may include restoring the fuel system to a resting state. Restoring the fuel system to a resting state may include closing FTIV 252, turning off ELCM pump 330, placing COV 315 in a first position, and closing CVV 429. Method 900 may then end.

FIG. 10 shows an example timeline 1000 for a leak test utilizing a dual-function ELCM in a plug-in hybrid vehicle using the method described herein and with regards to FIG. 9 as applied to the system described herein and with regards to FIGS. 1, 4, and 5A-D. Timeline 1000 includes plot 1005 indicating status of a canister vent valve (CVV) over time. Timeline 1000 further includes plot 1010 indicating the status of a fuel tank isolation valve (FTIV) over time. Timeline 1000 further includes plot 1015, indicating the status of an ELCM changeover valve over time; plot 1020, indicating the status of an ELCM vacuum pump over time; plot 1025, indicating pressure in a fuel tank over time; and plot 1030, indicating a fuel vapor canister pressure over time; and plot 1035, showing whether a leak is indicated over time. Line 1037 represents a fuel tank vacuum threshold for a 0.02" leak based on an ELCM reference check. Line 1039 represents a canister vacuum threshold for a 0.02" leak based on an ELCM reference check.

At time $t_0$, the fuel system is in a resting state. As such, the CVV is closed, as shown by plot 1005. The FTIV is closed, as shown by plot 1010. The ELCM COV is in the $1^{st}$ position, as shown by plot 1015, and the ELCM pump is off, as shown by plot 1020. The CPV may be considered to be maintained closed throughout timeline 1000. At time $t_1$, entry conditions for a leak test are met. Accordingly, the FTIV is opened, as indicated by plot 1010. The ELCM pump is turned on in a first (forward) direction, while the ELCM COV is maintained in the first position. As discussed herein and with regard to FIG. 5A, in this conformation, the ELCM may perform a reference check that compensates for humidity, barometric pressure, and fuel RVP.

The reference check proceeds from time $t_1$ to time $t_2$. With the FTIV in the open conformation, the fuel tank pressure decreases slightly, as indicated by plot 1025. At time $t_2$, the reference check is completed. Threshold vacuums are set for leak testing the fuel tank (line 1037) and the fuel vapor canister side of the fuel system (line 1039). The fuel system may then be placed in conformation for leak testing the fuel tank. The CVV is opened, as indicated by plot 1005, while the FTIV is maintained open, as indicated by plot 1010. The ELCM COV is placed in the $2^{nd}$ position, as indicated by plot 1015. As described herein and with regards to FIG. 5B, in this conformation, the ELCM vacuum pump may draw a vacuum on the fuel tank.

A vacuum is drawn on the fuel tank from time $t_2$ to time $t_3$, when the fuel tank vacuum indicated by plot 1025 reaches threshold 1037. Accordingly, no leak is indicated, as shown by plot 1035. The CVV is then closed, the FTIV maintained open, the ELCM pump turned off, and the ELCM COV returned to the $1^{st}$ position, as shown by plots 1005, 1010, 1020, and 1015, respectively. Accordingly, the Fuel tank pressure increases slightly, as shown by plot 1025.

At time $t_4$, the fuel system may be placed in conformation for leak testing the canister side. Accordingly, the CVV is maintained closed, and the FTIV maintained open, as shown by plots 1005 and 1010, respectively. The ELCM COV is placed in the $2^{nd}$ position, and the ELCM pump is activated in a second (reverse) direction, as shown by plots 1015 and 1020, respectively. As described herein and with regards to FIG. 5D, in this conformation, the ELCM may draw a vacuum on the fuel vapor canister side of the fuel system. A vacuum is drawn on the fuel vapor canister side of the fuel system from time $t_4$ to time $t_5$, when the canister pressure shown by plot 1030 reaches the threshold indicated by line 1039. With the FTIV opened, the fuel tank pressure rises during the canister side leak check, as air is drawn towards the fuel tank. No leak is indicated, as shown by plot 1035.

At time $t_5$, the leak test is finalized, and the fuel system may be restored to a resting state. The CVV is maintained closed, and the FTIV is closed, as shown by plots 1005 and 1010, respectively. The ELCM COV is returned to the first position, and the ELCM vacuum pump is turned off, as shown by plots 1015 and 1020.

The systems described herein and depicted in FIGS. 1, 4, 5A-5D and 6A-B, along with the method described herein and depicted in FIG. 9 may enable one or more systems and one or more methods. In one example, a fuel system for a vehicle, comprising: a fuel tank coupled to a fuel vapor canister via a fuel tank isolation valve; a canister vent valve coupled between the fuel vapor canister and atmosphere; an evaporative leak check module coupled between the fuel tank isolation valve and the fuel vapor canister, the evaporative leak check module comprising a reversible vacuum pump; and a control system configured with instructions stored in non-transitory memory, that when executed cause the control system to: open the fuel tank isolation valve; then determine a reference vacuum threshold; determine a first fuel tank pressure by drawing a vacuum on the fuel tank via operating the reversible vacuum pump in a first direction with the canister vent valve opened; determine a first fuel system pressure by drawing a vacuum on the fuel system via operating the reversible vacuum pump in a second direction, opposite the first direction, with the canister vent valve closed; indicate a fuel tank leak based on a comparison of the first fuel tank pressure to the reference vacuum threshold; and indicate a leak in the fuel system that is not in the fuel tank based on a comparison of the first fuel system pressure and the reference vacuum threshold. The evaporative leak check module may further comprise a reference orifice and a changeover valve operable between a first position and a second position, and determining a reference vacuum threshold may further comprise: placing the changeover valve in the first position; and drawing a vacuum on the reference orifice by operating the reversible vacuum pump in the first direction while maintaining the fuel tank isolation valve open. Drawing a vacuum on the fuel tank may further comprise: placing the changeover valve in the second position. Drawing a vacuum on the fuel system may further comprise: placing the changeover valve in the second position. The reversible vacuum pump may comprise a reversible motor coupled to an H-bridge circuit. The technical result of implementing this system is a decrease in evaporative emissions leak test false failures. By placing the ELCM between the fuel tank isolation valve and the fuel vapor canister, the reference vacuum threshold may compensate for fuel Reid Vapor Pressure. As such, when a vacuum is drawn on the fuel tank the reference vacuum threshold can be met during the allotted testing duration if no leak is present.

The systems described herein and depicted in FIGS. 1, 2, 3A-3D, 4, 5A-5D and 6A-B, along with the methods described herein and depicted in FIGS. 7 and 9 may enable one or more systems and one or more methods. In one example, a method for a fuel system, comprising: indicating a leak in a fuel tank following applying a vacuum to the fuel tank by running a vacuum pump in a first direction; then purging a fuel vapor canister to the fuel tank by running the vacuum pump in a second direction, opposite the first direction. Indicating a leak in the fuel tank may further comprise: determining a reference pressure by applying a vacuum to a reference orifice; determining a first fuel tank pressure following applying a vacuum to the fuel tank; and comparing the first fuel tank pressure to the reference pressure. Determining a reference pressure may further comprise placing a changeover valve in a first position, and applying a vacuum to the fuel tank may further comprise placing the changeover valve in a second position. Purging a fuel vapor canister to the fuel tank may further comprise: placing the changeover valve in the second position; and opening a fuel tank isolation valve. The method may further comprise opening a canister vent valve. The method may further comprise, following purging the fuel vapor canister to the fuel tank, closing the fuel tank isolation valve; placing the changeover valve in the first position; turning off the vacuum pump; sleeping a control system for a predetermined duration; then waking the control system; and during a first condition: opening the fuel tank isolation valve; placing the changeover valve in the second position; and purging the fuel vapor canister to the fuel tank by running the vacuum pump in the second direction. The first condition may comprise: a fuel tank vacuum greater than a vacuum threshold; a fuel vapor canister load greater than a load threshold; and a status where a vehicle comprising the fuel system is coupled to an external power source. Determining a reference pressure may further comprise: prior to applying a vacuum to the reference orifice, coupling the reference orifice to the fuel tank by opening a fuel tank isolation valve. The method may further comprise: following indicating a leak in the fuel tank, closing a canister vent valve; indicating a leak in a fuel canister side of the fuel system following applying a vacuum to fuel canister side of the fuel system by running a vacuum pump in a first direction. Indicating a leak in the fuel canister side of the fuel system may further comprise: determining a first fuel canister side pressure following applying a vacuum to the fuel canister side of the fuel system; and comparing the first fuel canister side pressure to the reference pressure. The technical result of implementing this method is a reduction in bleed emissions from the fuel vapor canister. The fuel vapor canister may be purged of its contents following a fuel system leak check, which may draw fuel vapor from the fuel tank into the canister. The method may also increase the efficiency of the vehicle, as the engine does not need to be turned on in order to purge the canister.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system, comprising:

determining a reference pressure by applying a vacuum to a reference orifice and placing a changeover valve in a first position, the changeover valve coupled between a fuel vapor canister and atmosphere;

indicating a leak in a fuel tank based on the reference pressure following applying a vacuum to the fuel tank by running a vacuum pump in a first direction; then purging the fuel vapor canister to the fuel tank by placing the changeover valve in a second position and running the vacuum pump in a second direction, opposite the first direction.

2. The method of claim 1, where indicating the leak in the fuel tank further comprises:

determining a first fuel tank pressure following applying the vacuum to the fuel tank; and comparing the first fuel tank pressure to the reference pressure.

3. The method of claim 1, where applying the vacuum to the fuel tank further comprises placing the changeover valve in the second position.

4. The method of claim 1, where purging the fuel vapor canister to the fuel tank further comprises:

opening a fuel tank isolation valve.

5. The method of claim 4, further comprising:

following purging the fuel vapor canister to the fuel tank, closing the fuel tank isolation valve;

placing the changeover valve in the first position;

turning off the vacuum pump;

sleeping an electronic control system for a predetermined duration; then waking the control system; and during a first condition:

opening the fuel tank isolation valve;

placing the changeover valve in the second position; and purging the fuel vapor canister to the fuel tank by running the vacuum pump in the second direction.

6. The method of claim 5, where the first condition comprises:

a fuel tank vacuum greater than a vacuum threshold;

a fuel vapor canister load greater than a load threshold; and a status where a vehicle comprising the fuel system is coupled to an external power source.

7. The method of claim 1, where determining the reference pressure further comprises:

prior to applying the vacuum to the reference orifice, coupling the reference orifice to the fuel tank by opening a fuel tank isolation valve.

8. A method for a fuel system, comprising:

determining a reference vacuum threshold by placing a changeover valve of an evaporate leak check module in a first position, the evaporate leak check module coupled between a fuel vapor canister and atmosphere;

opening a fuel tank isolation valve coupled between a fuel tank and the fuel vapor canister;

determining a first fuel system pressure by drawing a vacuum on the fuel system via operating a reversible vacuum pump of the evaporate leak check module in a first direction;

indicating a fuel system leak based on a comparison of the first fuel system pressure and the reference vacuum threshold; then purging contents of the fuel vapor canister to the fuel tank by placing the changeover valve in a second position and operating the reversible vacuum pump in a second direction, opposite the first direction, while maintaining the fuel tank isolation valve open.

9. The method of claim 8, where the evaporative leak check module further comprises a reference orifice, and where determining the reference vacuum threshold further comprises:

drawing a vacuum on the reference orifice by operating the reversible vacuum pump in the first direction.

10. The method of claim 9, where drawing the vacuum on the fuel system further comprises:

placing the changeover valve in the second position.

11. The method of claim 8, where the fuel system is within a plug-in hybrid vehicle, the method further comprising:

following purging contents of the fuel vapor canister to the fuel tank, closing the fuel tank isolation valve;

turning off the reversible vacuum pump;

sleeping a control system for a predetermined duration; then waking the control system; and during a first condition, comprising a fuel tank vacuum greater than a vacuum threshold, a canister load greater than a load threshold, and a vehicle status where the vehicle is coupled to an external power source:

opening the fuel tank isolation valve; and purging the fuel vapor canister to the fuel tank by running the reversible vacuum pump in the second direction.

* * * * *